US007243511B2

(12) United States Patent
Meguro

(10) Patent No.: US 7,243,511 B2
(45) Date of Patent: Jul. 17, 2007

(54) PENDANT

(76) Inventor: Takefumi Meguro, Shiko Building 3F, Taito 4-11-2, Taito-ku, Tokyo (JP)

( * ) Notice: Subject to any disclaimer, the term of this patent is extended or adjusted under 35 U.S.C. 154(b) by 0 days.

(21) Appl. No.: 10/909,727

(22) Filed: Aug. 2, 2004

(65) Prior Publication Data

US 2005/0028555 A1 Feb. 10, 2005

(51) Int. Cl.
*A44C 17/02* (2006.01)
*A44C 25/00* (2006.01)
*A44C 7/00* (2006.01)

(52) U.S. Cl. ..... 63/13; 63/31; 63/29.1; 63/23; 63/26

(58) Field of Classification Search ..... 63/13, 63/3, 29.1, 30; D11/1, 79
See application file for complete search history.

(56) References Cited

U.S. PATENT DOCUMENTS 207,869 A * 9/1878 Hessels ..... 63/12
215,626 A * 5/1879 Jeanne ..... 63/30
249,201 A * 11/1881 Oliver ..... 63/12
249,202 A * 11/1881 Oliver ..... 63/12
252,610 A * 1/1882 Mackinney ..... 63/13
298,762 A * 5/1884 Mackinney ..... 63/13
306,143 A * 10/1884 Feeley ..... 63/13
331,638 A * 12/1885 Hathaway ..... 63/13
360,395 A * 3/1887 Straat ..... 63/13
384,629 A * 6/1888 Joyce ..... 63/27
398,126 A * 2/1889 Brooks ..... 63/13
421,433 A * 2/1890 Rees ..... 63/13
477,025 A * 6/1892 Stern ..... 63/13
483,214 A * 9/1892 Gaynor ..... 63/13
502,801 A * 8/1893 Wodiska ..... 63/13
512,835 A * 1/1894 Mann ..... 63/13
527,359 A * 10/1894 Bonner ..... 63/13
799,056 A * 9/1905 Huber ..... 63/13
983,598 A * 2/1911 Auerbach ..... 63/12
4,028,908 A * 6/1977 Michael ..... 63/23
D256,003 S * 7/1980 Barr ..... D11/43
4,265,098 A * 5/1981 Wayne ..... 63/1.16
5,974,831 A * 11/1999 Afuku et al. ..... 63/26
6,006,547 A * 12/1999 Bergagnini ..... 63/26
6,293,128 B1 * 9/2001 Leufray-Simms ..... 63/23
6,550,276 B2 * 4/2003 Frank ..... 63/31
6,681,599 B2 * 1/2004 Meguro ..... 63/31
D519,051 S * 4/2006 Higuchi ..... D11/1
D522,398 S * 6/2006 Thapar ..... D11/79

* cited by examiner

*Primary Examiner*—J. J. Swann
*Assistant Examiner*—David Reese
(74) *Attorney, Agent, or Firm*—James E. Walton

(57) ABSTRACT

A pendant containing a jewel mounted in an ornamental piece supports the jewel away from a wearers neck, thereby enabling the a jewel to sparkle fully as the ornamental piece with the jewel swings delicately in synchronization with the motions of the wearer.

8 Claims, 11 Drawing Sheets

PENDANT

CROSS-REFERENCE TO RELATED APPLICATIONS

This application claims priority under 35 U.S.C. §119 to Japanese App. No. 2003-206571, filed Aug. 7, 2003, and which is incorporated herein by reference.

STATEMENT REGARDING FEDERALLY SPONSORED RESEARCH OR DEVELOPMENT

Not Applicable.

BACKGROUND OF THE INVENTION

The present invention relates to a pendant formed by a swingingly hung ornamental piece mounted with jewels such as diamonds and the like. Pendants vary in types and shapes. A pendant consisting of a necklace to be worn round the neck and an ornamental piece mounted with jewels such as diamonds and the like is generally formed having a necklace passed through a ring and the like which is linked to an ornamental piece hung therefrom or having a necklace brazed to both right and left side of an ornamental piece.

As shown in FIGS. 1 and 2, for example, a pendant 1 includes an ornamental piece 2 hung at the center of a necklace. A holder 4 formed of a metallic frame directly covers a girdle (not shown in the drawings) at a rim of a jewel 2*a* such as a diamond. The holder 4 is hung from a chain 5 of a necklace passed through a ring 3 formed on top of the holder 4.

However, a bottom portion of the ornamental piece 2 directly fits to the skin around lower part of the neck and the ornamental piece 2 itself hardly swings in synchronization with motions of a wearer while the pendant 1 is worn. Therefore, as light incident on the jewel 2*a* mounted in the ornamental piece 2 is defined in a certain direction, flashes emitted from the jewel 2*a* reflecting the light incident from various directions may not be exerted and brilliance of the jewel 2*a* can not be provided sufficiently. Accordingly, that the pendant becomes a less attractive product as an accessory.

On the other hand, FIG. 3 illustrates a pendant 10 in which a stable portion 15 is provided on a reverse side surface of a holder 13 having a chain-linking portion 12 on top, a protuberant hanging portion 17 with a hanging hole 18 formed at a tip thereof is formed in a generally central portion in a front surface of the holder 13, and an ornamental piece 20 is swingingly hung from the hanging hole 18.

In the pendant 10, the ornamental piece 20 hung from the holder 13 swings freely reserving a space at the back and allows the jewel 2*a* to reflect the light incident from various directions and to sparkle beautifully. However, that the holder 13 must be formed large enough to stabilize the pendant 10 and the hanging portion 17 must protrude by a large amount to reserve the space causes problems of providing poor usability and design as an accessory.

BRIEF SUMMARY OF THE INVENTION

It is therefore an object of the present invention to provide a pendant that enables a jewel mounted in an ornamental piece to sparkle fully when the ornamental piece swings delicately in synchronization with the motions of a wearer. And it is another object to provide a pendant which excels in safety and prevents itself from being unsteady or turning over when the wearer moves. Further, it is still another object to provide a pendant which excels in usability and design as an accessory.

A pendant of the invention provides a stable portion on a reverse side surface of a holder having a chain-linking portion for a linkage to accessories such as necklace and the like on top, a hanging portion protruding from a generally central top portion of the holder, and an ornamental piece swingingly hung from a hanging hole formed at a tip of the above-mentioned hanging portion. The tip of the hanging portion is formed in the most protrusive point in the holder when viewed from the side. The holder is formed in a shape selected from a group including a cylindrical shape, a donut shape and a board shape having a concave portion formed in a generally central portion. The ornamental portion is formed in a shape selected from a group including a generally oval shape, a generally heart shape, a generally tear-drop shape, a generally egg shape, and a polygonal shape. The ornamental piece comprises a jewel, a plurality of claw portions gripping a crown of the jewel, a locking cover for covering a pavilion of the jewel, and a ring fixed on a top portion of the above-mentioned locking cover, in which the jewel secured by the locking cover is swingingly hung from the holder by way of the ring engaged in the hanging hole of the holder. The ornamental piece comprises a jewel, a locking ring covering a girdle of the jewel, and a ring fixed on a top portion of the locking ring, in which the jewel secured by the locking cover is swingingly hung from the holder by way of the ring engaged in the hanging hole of the holder.

The holder forms a frame and the hanging portion extends forwardly from the top of the frame to swingingly suspend the ornamental piece In a position spaced forwardly of the holder. When the pendant is considered in front view, the ornamental piece appears to be in the space defined by the frame, and the frame appears to surround the ornamental piece. confining the same within the outer contour thereof, at least when the ornamental piece hangs vertically downwardly from the hanging portion. The frame and the ornamental piece can be shaped complementarily to each other, such that the holder appears to frame the ornamental piece.

DETAILED DESCRIPTION OF THE INVENTION

Figure 1:
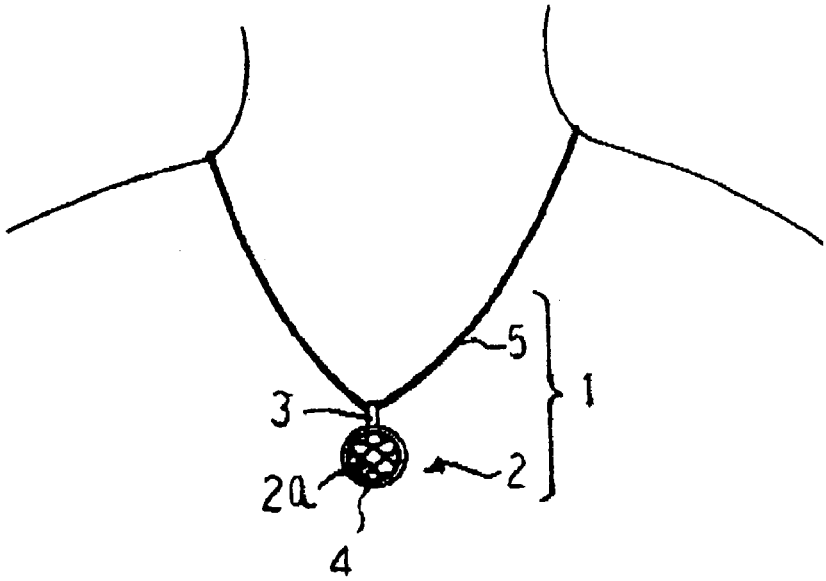
FIG. 1 is a front view showing a conventional pendant.
Figure 2:
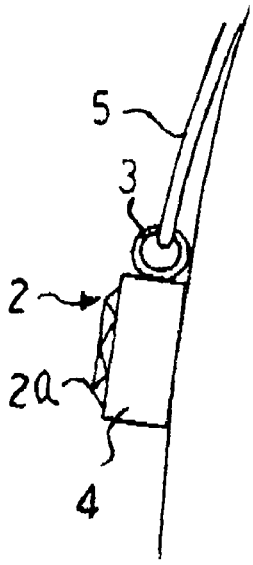
FIG. 2 is a side view showing the conventional pendant.
Figure 3:
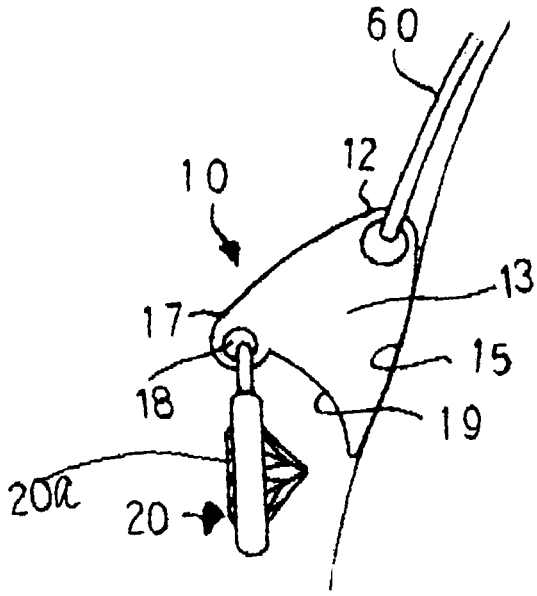
FIG. 3 is a side view showing a pendant with an ornamental piece swingingly hung therefrom.
Figure 4:
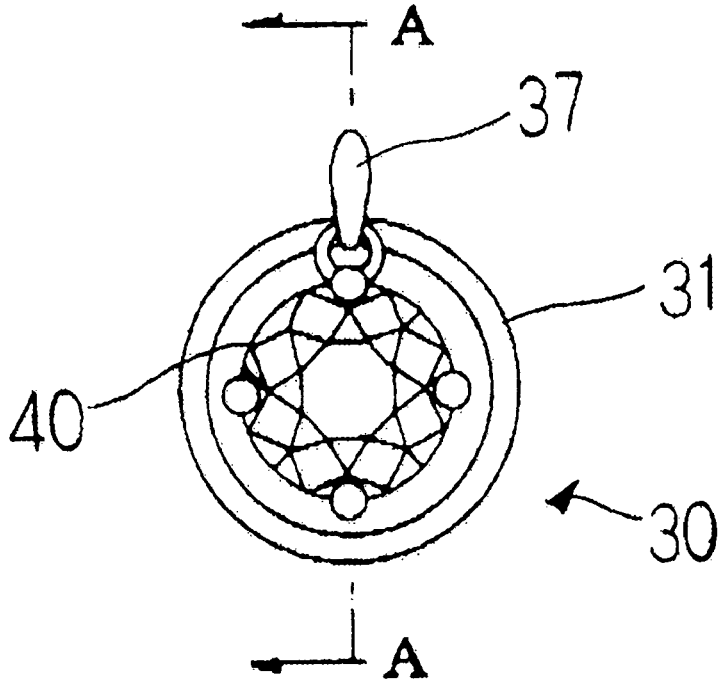
FIG. 4 is a front view showing a first pendant of the present invention.
Figure 5:
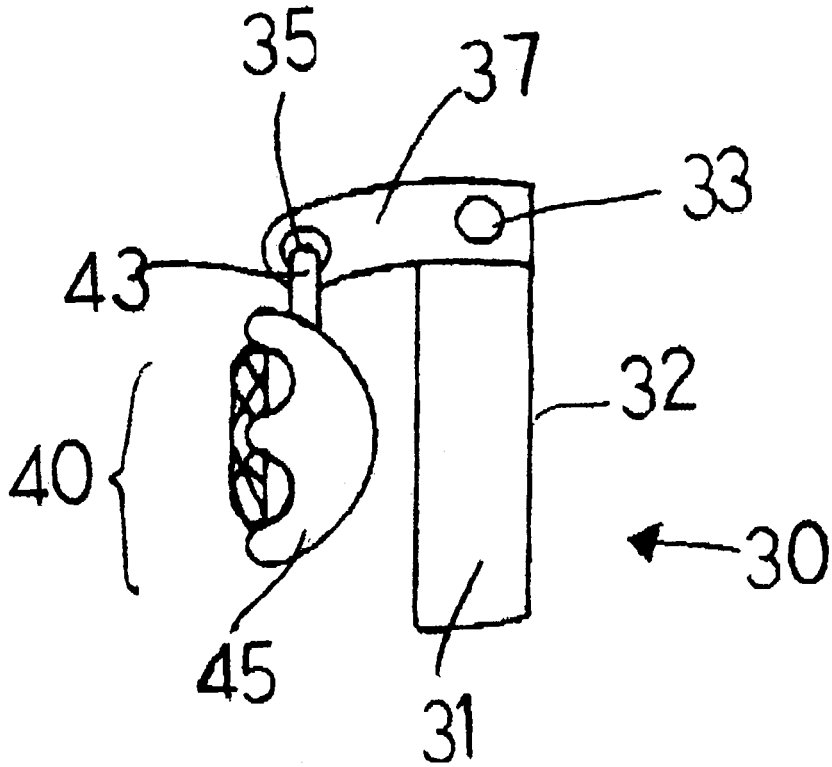
FIG. 5 is a side view showing the first pendant of the present invention.
Figure 6:
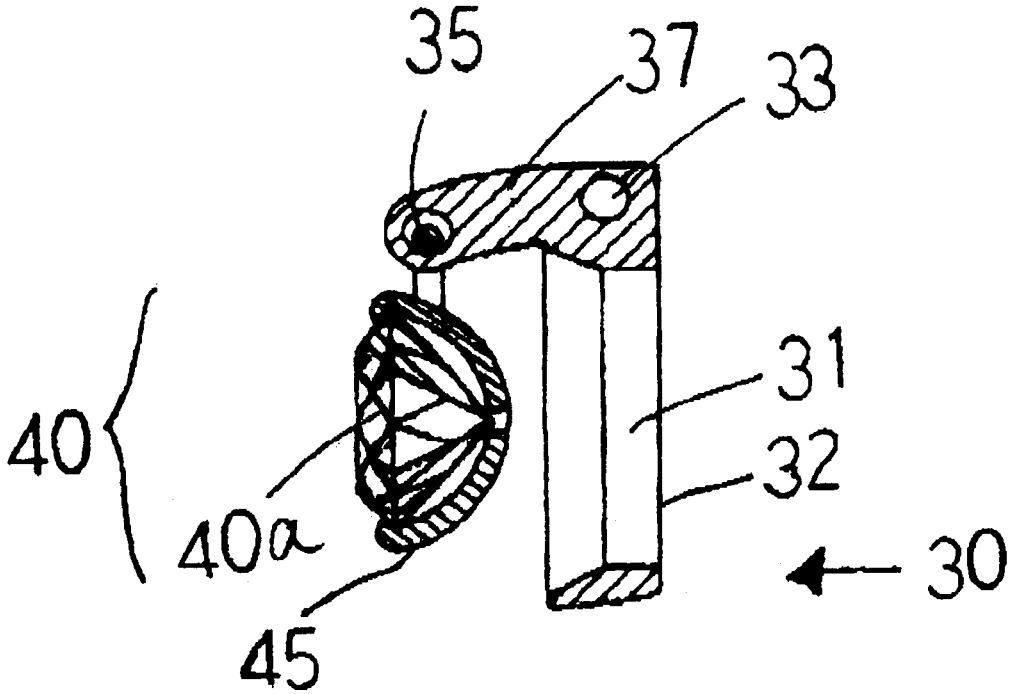
FIG. 6 is a sectional view taken on line A-A of FIG. 4 showing the first pendant of the present invention.
Figure 7:
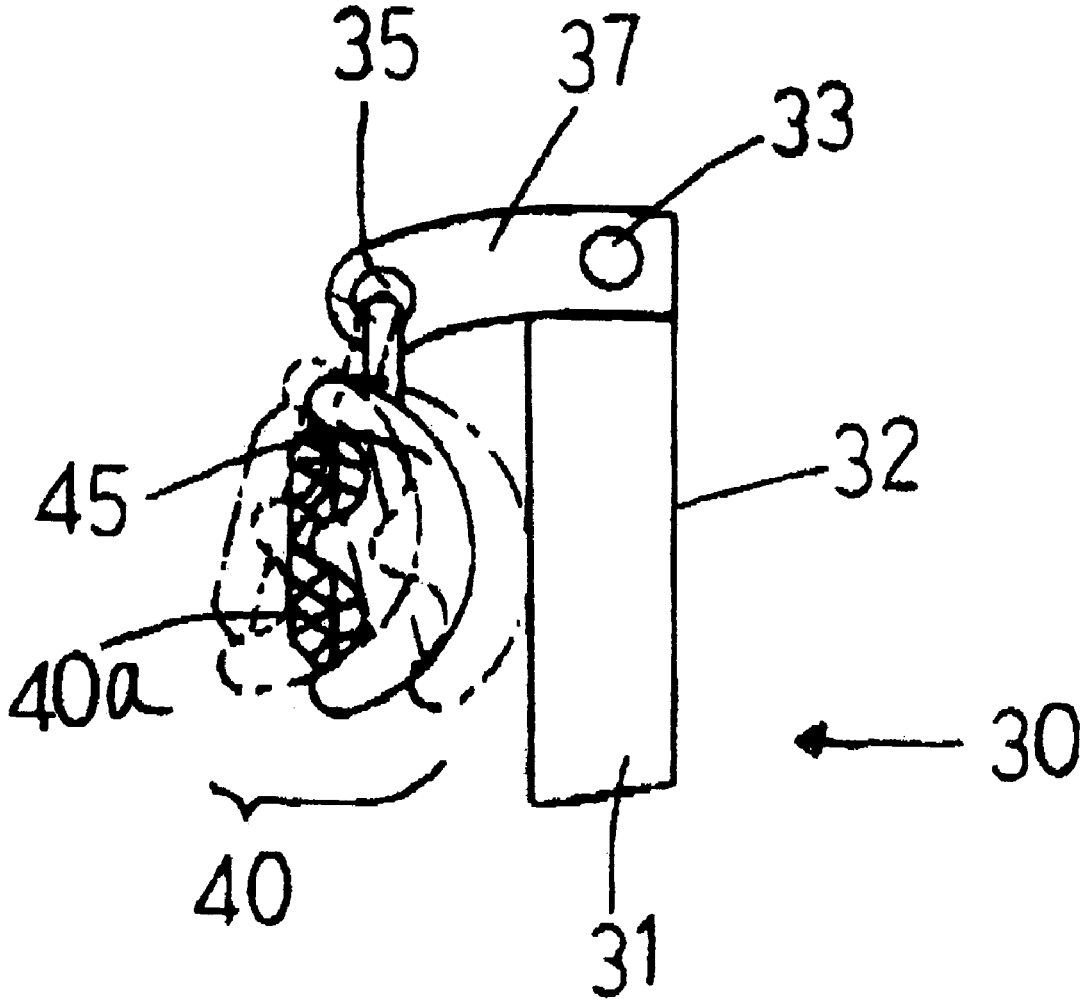
FIG. 7 is an explanatory view showing the first pendant of the present invention in the state of swinging forward and backward.
Figure 8:
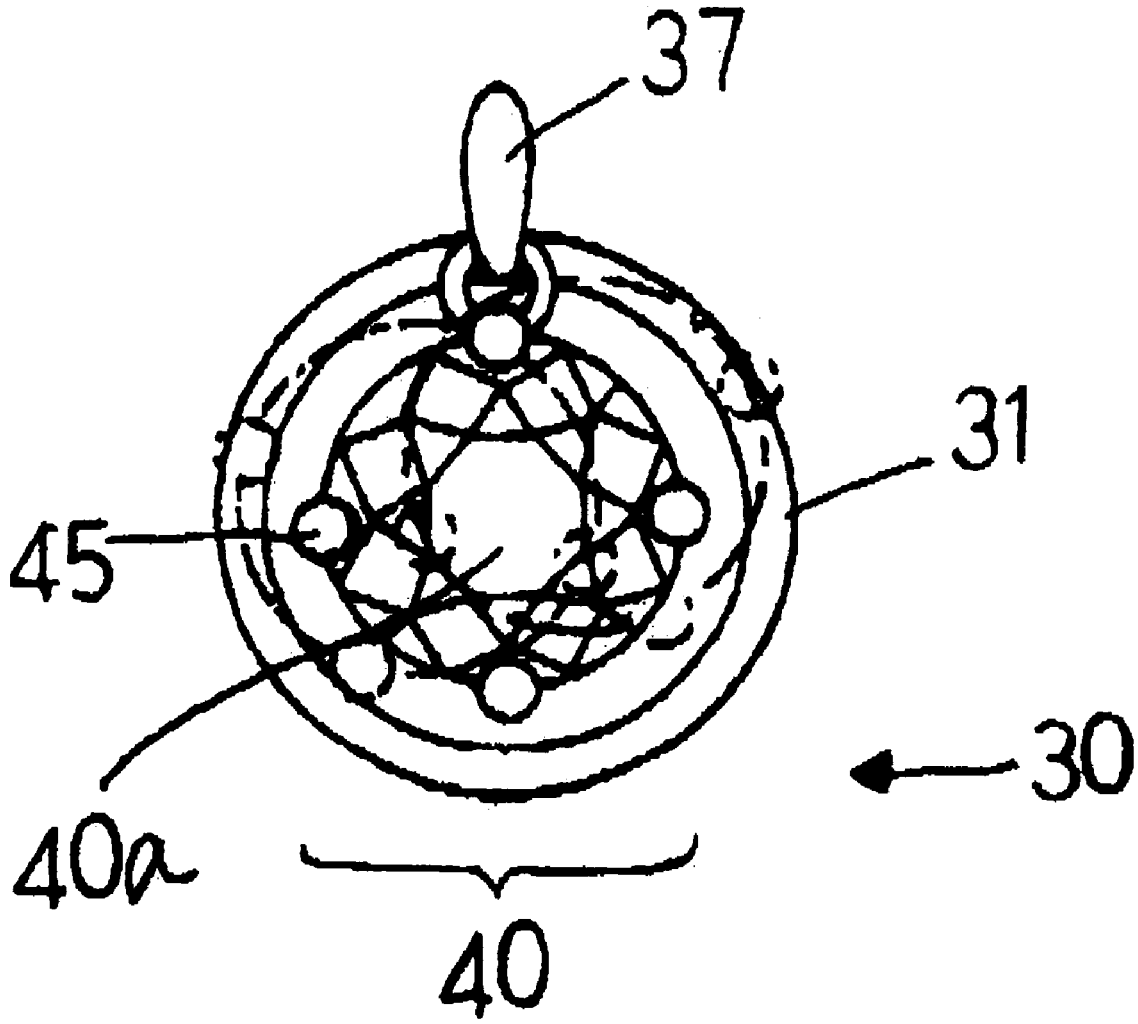
FIG. 8 is an explanatory view showing the first pendant of the present invention in the state of swinging right and left.

Referring now to the drawings, preferred embodiments of the present invention are described more particularly. FIG. 4 is a front view of a first pendant with a first ornamental piece fixed to a first holder for showing a first embodiment of the present invention, FIGS. 5 and 6 are a side view and a sectional view of the first pendant, and FIGS. 7 and 8 are explanatory views for showing the first pendant of the present invention in the states of swinging forward and backward, and right and left, respectively.

The first pendant 30 comprises a holder 31 which is formed of materials, for example, precious metals such as gold, silver, platinum, metals such as brass or synthetic resin in a cylindrical shape, and a first ornamental piece 40 mounted with a jewel such as a diamond, an emerald, a ruby and the like. A chain for necklaces (not shown) is used as conventional pendants in order to hang the first pendant 30 in a front part of the neck.

As shown in FIG. 4, the holder 31 of the first pendant 30 is formed in a generally oval cylinder when viewed form the front and a hanging portion 37 is provided in a generally central, upper front part of the holder 31. As seen, the oval shape of the holder 31 forms a frame defining an area. An opening, such as a linking hole 33, is provided at a joint portion of the hanging portion 37. The first pendant 30 can be hung from the neck by passing the chain for a necklace through the linking hole 33.

However, with respect to the first pendant 30, means of linkage to the chain for a necklace has no specific limit. For example, both ends of the chain for a necklace cut in the middle can be brazed directly to right and left upper portions on a rim of the holder 31, thereby providing the first pendant 30 with higher stability. Additionally, a size of the linking hole 33 has no specific limit so that not only a chain for necklaces with a small diameter but also a chain for necklaces with a large diameter, and a necklace of a string of pearls or precious stones can pass through and hang the first pendant 30 round the neck.

In the event the first pendant 30 is viewed from the side, it becomes clear that the above-mentioned hanging portion 37 is protruded from a top portion of the holder 31 and a hanging hole 35 is formed at a tip of the hanging portion 37. The holder 31 and the first ornamental piece 40 are linked by a ring 43 provided on the ornamental portion 40 for passing through the hanging hole 35, as will be mentioned below. Besides, the tip of the hanging portion 37 is adjusted to reach the highest level in the first pendant 30, and more specifically, a height from the tip of the hanging portion 37 to a stable portion 32 of the holder 31 is arranged at least larger than the depth of the jewel 40*a* mounted on the first ornamental piece 40 so that the first ornamental piece 40 hung from the holder 31 can swing back and forth freely (refer to FIG. 7). That is, a certain amount of space between an inner end of the jewel 40*a* and the neck of a wearer is reserved at all times, so that the deepest portion of the jewel 40*a* is prevented from directly touching the neck even though the first ornamental piece 40 swings back and forth when the pendant 30 is worn.

Figure 18:
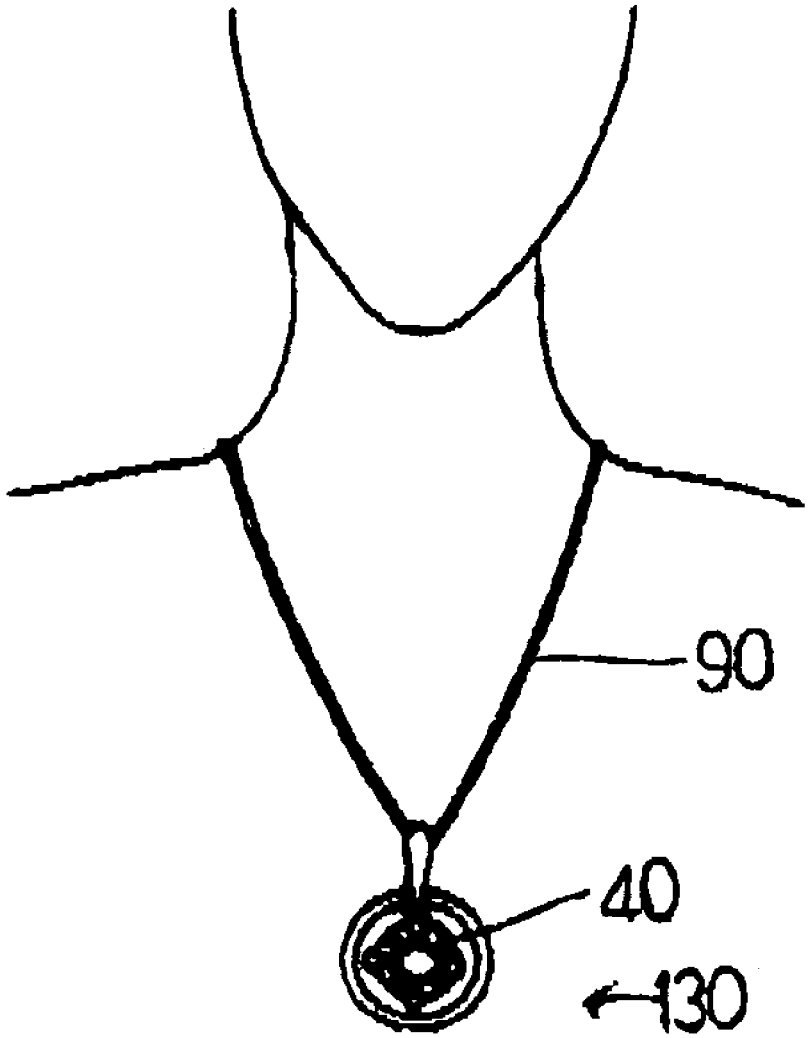
FIG. 18 is a front view showing a usage condition of the pendant of the present invention.

A stable portion 32 is formed on a reverse surface of the holder 31. The stable portion, which is a flat surface when viewed from the side, enables the holder 31 to make flat contact with the skin in order to stay stably on the lower part of the neck regardless of the wearer's motion. Further, in the first pendant 30, the holder 31 is formed of material such as precious metal and the like and has a larger weight than the first ornamental piece 40 mounted with the jewel 40*a*. Accordingly, the first ornamental piece 40 can face forward and prevent the holder 31 from being warped or turned inside out even in the event the pendant is worn (refer to FIG. 18).

On the other hand, the holder 31 is preferably arranged to have a diameter at least larger than a diameter of the jewel 40*a* mounted on the ornamental piece 40. But it is also acceptable to form a holder 31 unobtrusively in a similar size to the first ornamental piece or in a larger size to some degree for adding taste in design. The arrangement of the holder at the above-mentioned size prevents the jewel 40*a* in the first ornamental piece 40 when hung therefrom from hitting an inner circular surface of the holder 31, though most of the jewels represented by the jewel 40*a* are generally conical in shape (having a narrower end) at their pavilions (bottom portion). Therefore, the first ornamental piece 40 swings freely toward right and left in the pendant 30 (refer to FIG. 8).

In the first ornamental piece 40, the jewel 40*a* is grasped by a generally cup-like shaped locking cover 45 for covering all over the pavilion of the jewel 40*a* and a plurality of claw portions gripping a crown positioned at the top of the jewel 40*a*, and a ring 43 provided on an edge of the locking cover 45 is linked to a hanging hole 35 of the holder 31, as shown in FIGS. 5 and 6.

Figure 9:
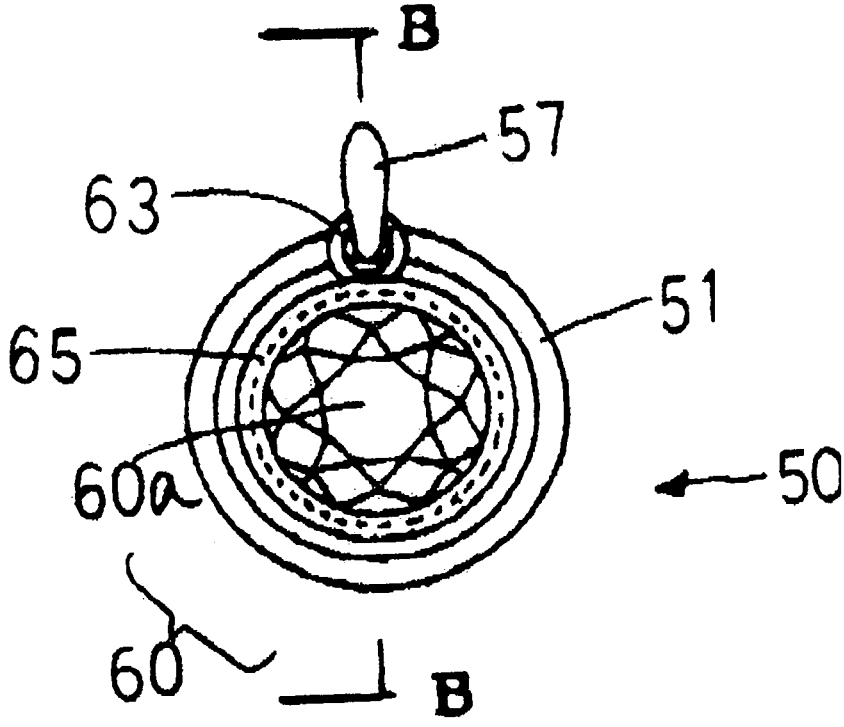
FIG. 9 is a front view showing a second pendant of the present invention.
Figure 10:
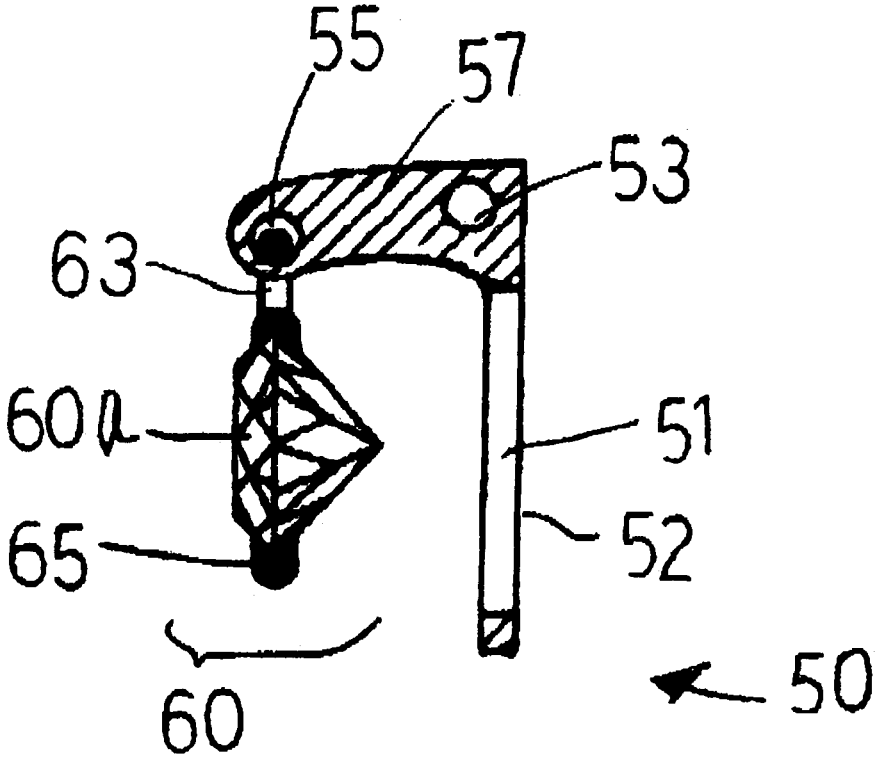
FIG. 10 is the sectional view taken on line B-B of FIG. 9 showing the second pendant of the present invention.

FIGS. 9 and 10 are a front view and a side view of the second pendant in which a second ornamental piece is provided in a second holder for showing a second embodiment of the present invention.

The pendant 50 comprises a holder 31 which is formed of materials, for example, a precious metal such as gold, silver, platinum, metals such as brass in a donut shape and a second ornamental piece 60 mounted with a jewel 60*a* such as a diamond, an emerald, a ruby and the like. A chain for necklaces (not shown) is used as conventional pendants in order to dangle the second ornamental piece 60 in a front part of the neck.

As shown in FIG. 9, the holder 51 of the second pendant 50 is formed in a generally donut-shaped thick-walled board body when viewed from the front and a hanging portion 57 shaped as a plate is provided in a generally central, upper front part of the holder 51. An opening as a linking hole 53 is provided at a joint portion of the hanging portion 57. The second pendant 50 can be hung round the neck by passing the chain for a necklace through the linking hole 53.

Incidentally, an aspect that the linking hole 53 of the second pendant 50 has no specific limits in shape and position is similar to the linking portion 33 of the first pendant 33, thereby omitting descriptions here.

In the event the second pendant 50 is viewed from the side, it becomes clear that the above-mentioned hanging portion 57 is protruded from a top portion of the holder 51 which has thickness of a certain degree. And a hanging hole 55 for passing a ring 63 of the second ornamental piece 60 through as will be mentioned below and for linking the holder 51 to the first ornamental piece 40 is provided at a tip of the hanging portion 57. Besides, the tip of the hanging portion 57 is adjusted to reach the highest level in the first pendant 50, and more specifically, a height from the tip of the hanging portion 57 to a stable portion 52 of the holder 51 is arranged at least larger than the depth of the jewel 60*a* mounted in the second ornamental piece 60 so that the second ornamental piece 60 hung from the holder 51 can swing back and forth freely in a same manner as the first pendant 30. A certain amount of space between a inner end of the jewel 60*a* and the neck of a wearer is reserved at all times, so that the deepest portion of the jewel 60*a* mounted in the second ornamental piece 60 is kept away from touching directly to the neck even though the second ornamental piece 60 swings back and forth in the event that the pendant 50 is worn.

Besides, an aspect that a stable portion 52 is formed flat on a reverse surface of the holder 51 in the second pendant 50 and enables the holder 51 to make flat contact with the skin is similar to the stable portion 32 of the first pendant 30, thereby omitting the descriptions here.

Further, an aspect that the holder 51 is preferably arranged to have a diameter at least larger than a diameter of the jewel 60*a* mounted in the second ornamental piece 60 is similar to the first pendant 30, thereby omitting the descriptions here.

Furthermore, a locking ring 65 covers a girdle at a rim of the jewel 60*a* for grasping the jewel 60*a*. And the second ornamental piece 60 hung from the second pendant 50 is linked to the locking hole 55 of the holder 51 by a ring 63 provided at a top portion of the locking ring 65, as shown in FIGS. 9 and 10.

Figure 11:
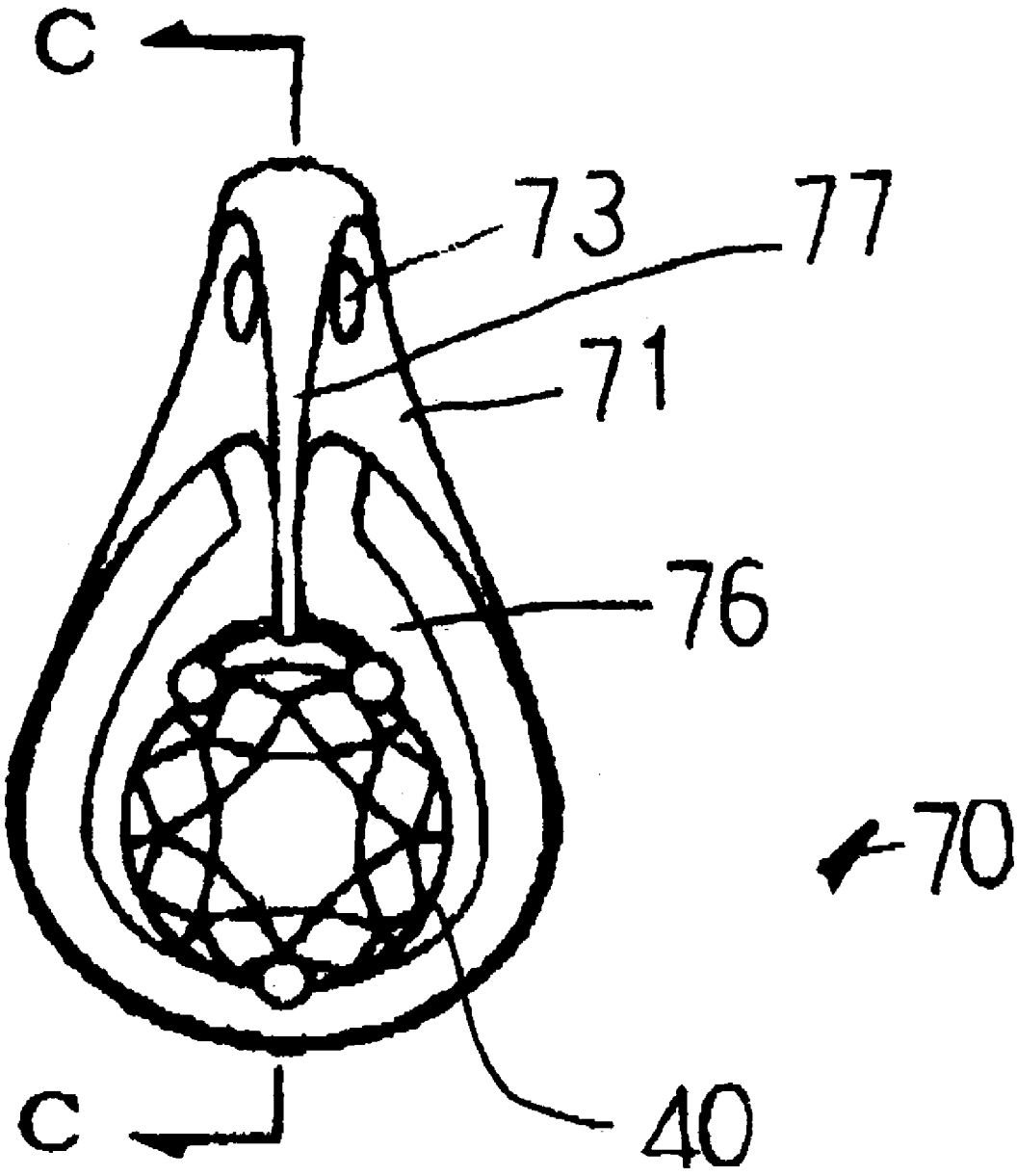
FIG. 11 is a front view showing a third pendant of the present invention.
Figure 12:
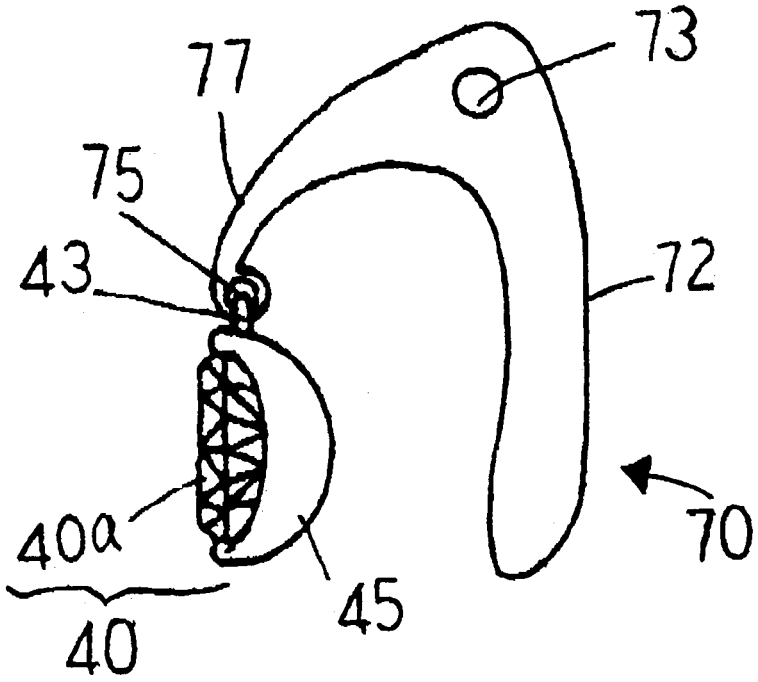
FIG. 12 is a side view showing the third pendant of the present invention.
Figure 13:
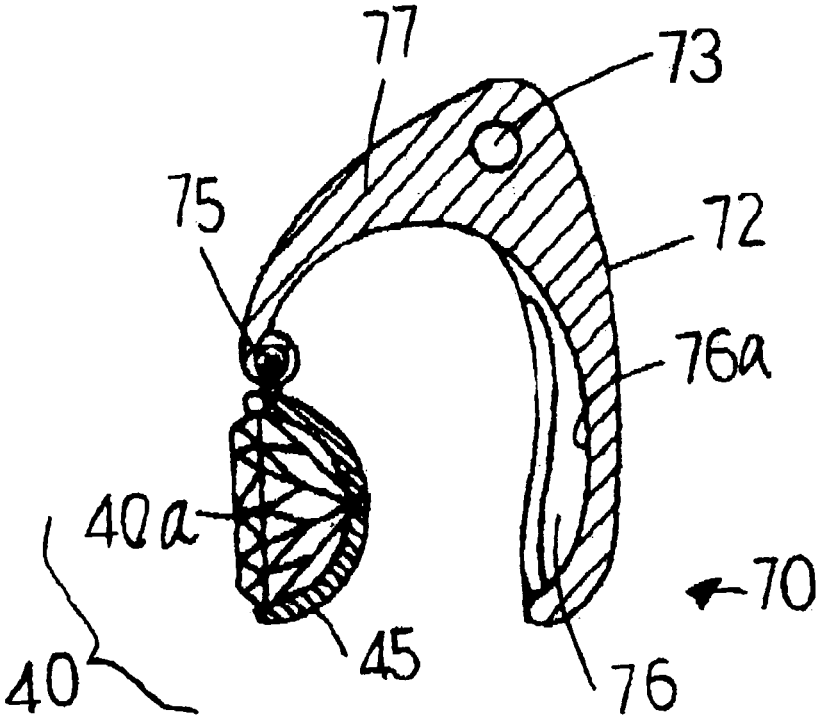
FIG. 13 is the sectional view taken on line C-C of FIG. 11 showing the third pendant of the present invention.

FIGS. 11, 12 and 13 are a front view, a side view and a sectional view respectively of the third pendant in which the first ornamental piece is provided in a third holder for showing a third embodiment of the present invention.

The third pendant 70 comprises a holder 71 which is formed of materials, for example, a precious metal such as gold, silver, platinum, metals such as bass and the like in a board shape and provides a concave portion 76 at generally central portion thereof, and a first ornamental piece 40. And a chain for necklaces (not shown) is used for dangling the first ornamental piece 40 in a front part of the neck.

As shown in FIG. 11, the holder 71 of the third pendant 70 consists of a thick-walled board body in a tear-drop shape when viewed from the front, a concave portion 76 positioned at a generally central portion inwardly, and a hanging portion 77 protruding and bending downward from an upper, front, generally central portion thereof. The third pendant 70 can be hung from the neck by passing the chain for a necklace through the linking hole 73

Incidentally, an aspect that the linking hole 73 of the third pendant 70 has no specific limits in shape and position is similar to the linking portion 33 of the first pendant 33, thereby omitting descriptions here.

In the event the third pendant 70 is viewed from the side, it becomes clear that the above-mentioned hanging portion 77 is protruded from a top portion of the holder 71 which has thickness of a certain degree. And a hanging hole 75 for passing a ring 43 of the first ornamental piece 40 through as will be mentioned below and for linking the holder 71 to the first ornamental piece 40 is provided at a tip of the hanging portion 77. Besides, the tip of the hanging portion 77 is adjusted to reach the highest level in the third pendant 70, and more specifically, a height from the tip of the hanging portion 77 to a bottom surface 76*a* in the concave portion 76 of the holder 71 is at least arranged larger than the depth of the jewel 40*a* mounted in the second ornamental piece 60 so that the first ornamental piece 40 hung from the holder 71 can swing back and forth freely in the third pendant 70. A certain amount of space between a inner end of the jewel 40*a* mounted in the first ornamental piece 40 and the neck of a wearer is reserved at all times, so that the deepest portion of the jewel 60*a* is kept away from touching directly to the neck even though the first ornamental piece 40 swings back and forth in the event that the pendant 50 is worn.

An aspect that a stable portion 72 is formed flat on a reverse surface of the holder 71 in the third pendant 70 and enables the holder 71 to make flat contact with the skin is similar to the stable portion 32 of the first pendant 30, thereby omitting the descriptions here. And in the third pendant 70, a lower part of the holder 71 can be curved slightly forward in order to make the concave portion 76 unobtrusive in terms of design.

Further, in the third pendant 70, a width of the concave portion 76 in the holder 71 preferably arranged at least longer than a diameter of the jewel 40*a* mounted in the first ornamental piece 40 in order to prevent the pavilion of the jewel 40*a* from hitting the inner circular surface of the concave portion 76 in the holder 71 and to allow the first ornamental piece 40 to swing back and forth freely.

Furthermore, the first ornamental piece 40 hung from the third pendant 70 is similar to the ornamental portion hung from the first pendant 30, thereby omitting the descriptions.

Figure 14:
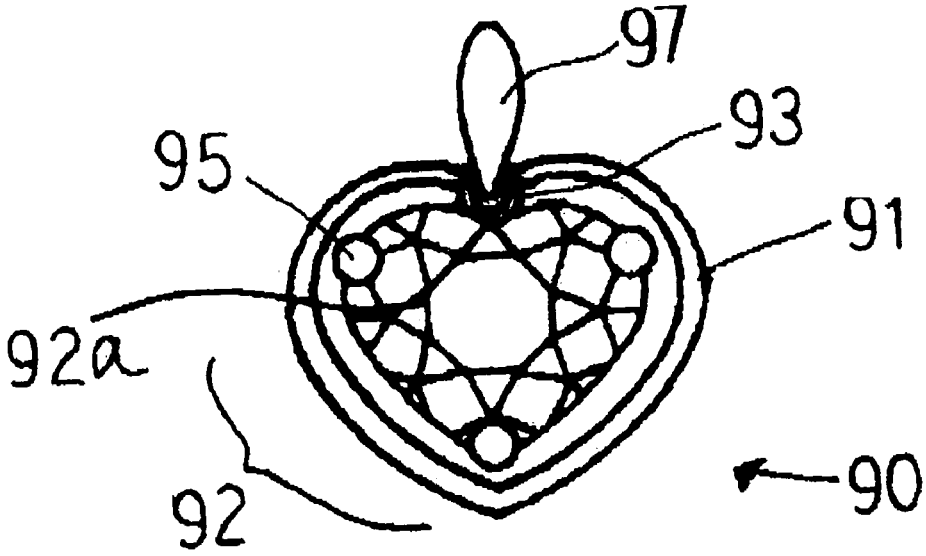
FIG. 14 is a front view showing a fourth pendant of the present invention.

FIG. 14 is a front view of a fourth pendant for showing a fourth embodiment of the present invention.

As shown in FIG. 14, the holder 91 of the fourth pendant 90 is formed to be generally heart shaped when viewed form the front and a hanging portion 97 is provided in a generally central, upper front part of the holder 91. Additionally, an opening as a linking portion (not shown) for passing a chain for a necklace through is provided at a tip of the holder 91 in the same level as the hanging portion 97.

In the fourth ornamental piece 92 hung from the fourth pendant 90, a jewel 92*a* cut into a heart shape is grasped between a locking cover (not shown) for covering the jewel 92*a* at a pavilion and a plurality of claw portions 95 for gripping the jewel 92*a* at a crown. And a ring 93 provided on an rim of the locking cover is linked to a hanging hole. The fourth ornamental piece 92 has basically a similar structure as the first ornamental piece 40.

The fourth pendant 90 is used in a similar manner as the pendants mentioned above, thereby omitting the descriptions here.

Figure 15:
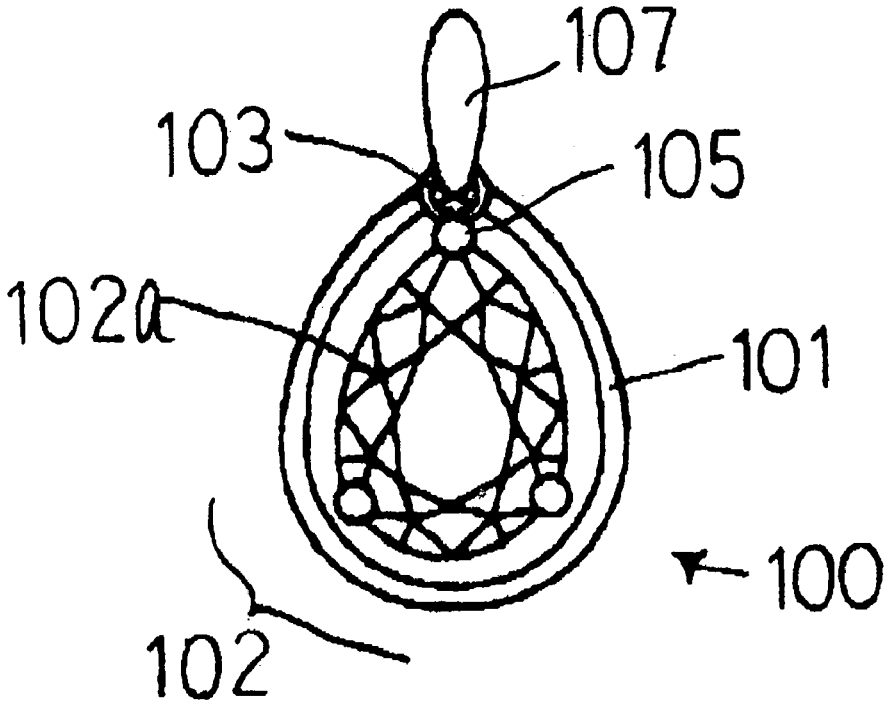
FIG. 15 is a front view showing a fifth pendant of the present invention.

FIG. 15 is a front view of a fifth pendant for showing a fifth embodiment of the present invention.

As shown in FIG. 15, the holder 101 of the fifth pendant 100 is formed in a generally tear-drop shaped cylinder when viewed form the front and a hanging portion 107 is provided in a generally central, upper front part of the holder 101. Additionally, an opening as a linking portion (not shown) for passing a chain for a necklace through is provided at a tip of the holder 101 on the same level as the hanging portion 107.

In the fifth ornamental piece 102 hung from the fifth pendant 100, a jewel 102*a* cut into a teardrop shape is grasped between a locking cover (not shown) for covering the jewel 102*a* at a pavilion and a plurality of claw portions 105 for gripping the jewel 102 at a crown. And a ring 103 provided on an rim of the locking cover is linked to a hanging hole (not shown) of the holder 101.

The fifth pendant 100 is used in a similar manner as the pendants mentioned above, thereby omitting the descriptions here.

While the invention has been described in terms of several preferred embodiments, it is recognized that the present invention can be practiced with modification within the spirit and scope of the appended claims.

For example, in the pendant of the present invention, not only the second ornamental piece or other ornamental pieces can be hung from the first holder of the first pendant but also the first ornamental piece or other ornamental piece can be hung from the second pendant. Varying combinations of both pendants and ornamental pieces are possible.

Figure 16:
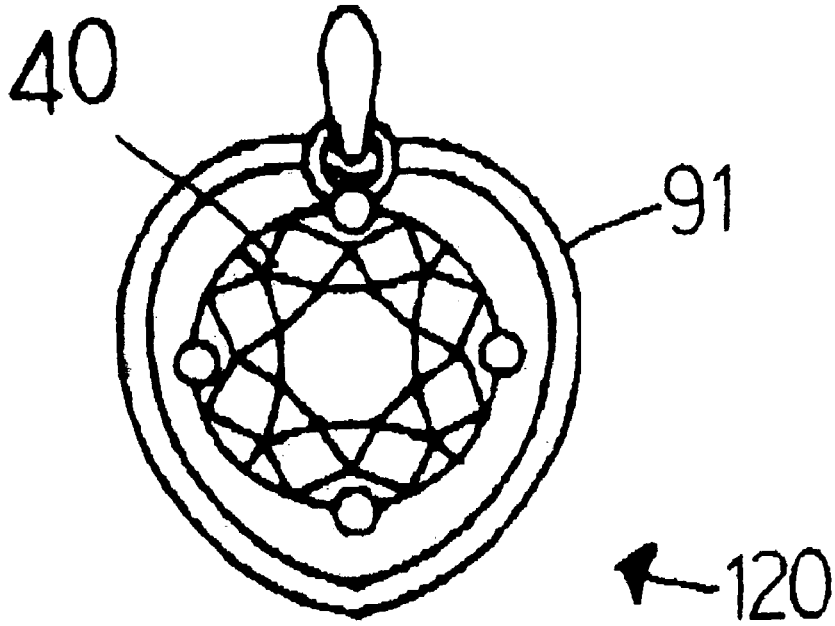
FIG. 16 is a front view showing a third holder holding a first ornamental piece.
Figure 17:
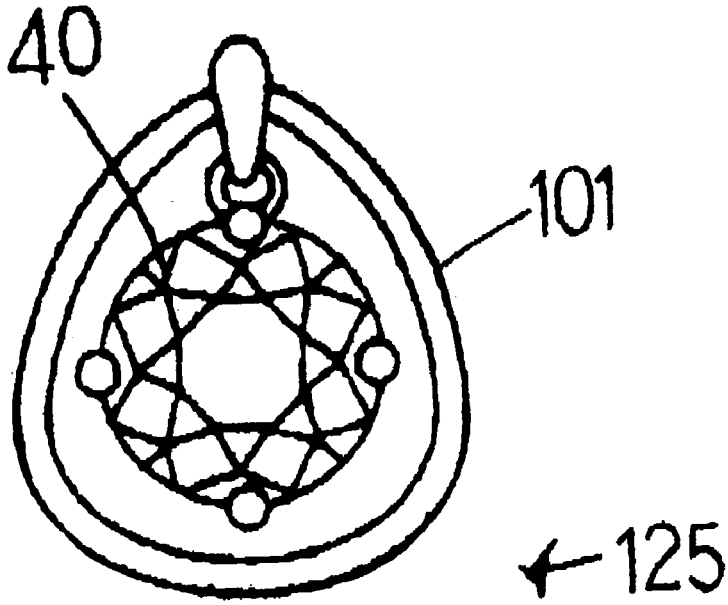
FIG. 17 is a front new showing a fourth holder holding the first ornamental piece.

FIG. 16 is a front view of a pendant 120 in which the first ornamental piece 40 is hung from the fourth holder 91, and FIG. 17 is a front view of a pendant 125 in which the first ornamental piece 40 is hung from the fifth holder 101.

Further, there is no specific limit in type of material or shape of the jewel mounted in the ornamental piece. For example, a faceted jewels other than a diamond, a ruby, a sapphire, an emerald, a semi precious stone, a cabochon-cut semi-precious stone such as an opal, or a round-shaped pearl, precious metal in a mirror ball shape and the like are acceptable.

With the pendant relating to the present invention, a jewel mounted in a ornamental portion can sparkle sufficiently while swinging delicately in synchronization with motions of a wearer. And in the event of wearing the pendant, the holder formed of precious metal has a weight and makes a flat contact by a stable portion without being warped or turned inside out. Accordingly, the holder allows the ornamental piece of the pendant to face forward at all times. Further, varying combinations of several cylindrical holders and ornamental pieces in various shapes enables the pendant to provide the ornamental piece unobtrusively and to excel in design as an accessory.

The invention claimed is:

1. A pendant comprising:

a holder comprising a frame having a peripheral edge defining a shape; said shape defining an open interior area; said frame edge defining a first plane forming a stable portion on a reverse side thereof which is adapted to rest against a wearer;

a hanging portion protruding outwardly from and generally perpendicularly to a generally central top portion of the holder, said hanging portion having a first end fixed to said holder and a second, free, end spaced outwardly from said first plane; and an ornamental piece swingingly hung from said hanging portion by a ring near said hanging portion second end; said holder being disposed entirely behind said ornamental piece; said ring defining a second plane spaced forwardly of, and generally parallel to said first plane when said pendant is suspended generally vertically; said ornamental piece having a size smaller than the area of said open interior of said frame; said ornamental piece being positioned forwardly of said open interior of said frame such that said ornamental piece is generally in said second plane when said pendant is suspended generally vertically; wherein, when said pendant is worn by a wearer, said frame will rest against said wearer and, when said pendant is considered in front view, the ornamental piece is generally aligned with said open interior of said frame, and said frame visually surrounds the ornamental piece and visually confines the ornamental piece within the outer contour of said frame, at least when the ornamental piece hangs vertically downwardly from the hanging portion.

2. The pendant as claimed in claim 1 wherein said tip of the hanging portion is formed in a forward most point in said holder when viewed from the side.

3. The pendant as claimed in claim 1 wherein said holder is formed in a shape selected from a group including a cylindrical shape, a donut shape and a board shape having a concave portion in a generally central portion.

4. The pendant as claimed in claim 1 wherein said ornamental portion is formed in a shape selected from a group including a generally oval shape, a generally heart shape, a generally tear-drop shape, a generally egg shape, and a polygonal shape.

5. The pendant as claimed in claim 1 wherein said ornamental piece comprises a jewel, a plurality of claw portions gripping a crown of said jewel, a locking cover for covering a pavilion of said jewel, and said ring fixed on a top portion of said locking cover, and said jewel secured by the locking cover is swingingly hung from said holder by way of said ring engaged in a hanging hole in the hanging portion of the holder.

6. The pendant as claimed in claim 1 wherein said ornamental piece comprises a jewel, a locking ring covering a girdle of said jewel, and said ring fixed on a top portion of said locking ring, and said jewel secured by the locking ring is swingingly hung from said holder by way of said ring engaged in a hanging hole in the hanging portion of the holder.

7. The pendent as claimed in claim 1 wherein said frame and the ornamental piece are shaped complementarily to each other.

8. The pendent as claimed in claim 7 wherein the frame defines an area larger than the ornamental piece, such that the frame appears to surround the ornamental piece.

* * * * *